US011242636B2

(12) United States Patent
Erickson et al.

(10) Patent No.: US 11,242,636 B2
(45) Date of Patent: Feb. 8, 2022

(54) LAUNDRY TREATING APPLIANCE WITH DYNAMIC BALANCER

(71) Applicant: WHIRLPOOL CORPORATION, Benton Harbor, MI (US)

(72) Inventors: Donald E. Erickson, Stevensville, MI (US); Mark R. Haslanger, South Bend, IN (US); Stephen D. Ostdiek, Saint Joseph, MI (US); Jaime E. Rodriguez, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 223 days.

(21) Appl. No.: 16/784,760

(22) Filed: Feb. 7, 2020

(65) Prior Publication Data

US 2020/0173091 A1 Jun. 4, 2020

Related U.S. Application Data

(63) Continuation of application No. 15/619,761, filed on Jun. 12, 2017, now Pat. No. 10,590,585, which is a continuation of application No. 14/287,596, filed on May 27, 2014, now Pat. No. 9,708,742.

(51) Int. Cl.
*D06F 37/22* (2006.01)
*D06F 37/24* (2006.01)

(52) U.S. Cl.
CPC ..... *D06F 37/225* (2013.01); *D06F 37/245* (2013.01); *Y10T 29/49909* (2015.01)

(58) Field of Classification Search
None
See application file for complete search history.

(56) References Cited

U.S. PATENT DOCUMENTS

| | | | |
|---|---|---|---|
| 4,044,626 | A | 8/1977 | Hayashi et al. |
| 5,916,274 | A | 6/1999 | Lee et al. |
| 6,550,292 | B1 | 4/2003 | Southworth et al. |
| 8,196,441 | B2 | 6/2012 | Hendrickson et al. |
| 8,388,695 | B2 | 3/2013 | Hendrickson et al. |
| 8,397,328 | B2 | 3/2013 | Hendrickson et al. |
| 8,397,544 | B2 | 3/2013 | Hendrickson et al. |
| 8,438,881 | B2 | 5/2013 | Ihne et al. |
| 8,813,526 | B2 | 8/2014 | Doyle et al. |
| 2010/0000264 | A1 | 1/2010 | Luckman et al. |
| 2010/0000581 | A1 | 1/2010 | Doyle et al. |
| 2015/0322615 | A1 | 11/2015 | Borlin et al. |

*Primary Examiner* — Rita P Adhlakha
(74) *Attorney, Agent, or Firm* — McGarry Bair PC

(57) ABSTRACT

A dynamic balancer device for mounting to and balancing a rotatable drum in a laundry treating appliance comprises an enclosed non-metal annular housing having a radial circumferential wall, an annular metal race within the non-metal annular housing disposed against the radial circumferential wall, and a mass disposed in the annular race and movable therein.

20 Claims, 6 Drawing Sheets

LAUNDRY TREATING APPLIANCE WITH DYNAMIC BALANCER

CROSS REFERENCE TO RELATED APPLICATIONS

This application is a continuation of U.S. patent application Ser. No. 15/619,761, filed Jun. 12, 2017, now U.S. Pat. No. 10,590,585, issued Mar. 17, 2020, which is a continuation of U.S. patent application Ser. No. 14/287,596, filed May 27, 2014, now U.S. Pat. No. 9,708,742, issued Jul. 18, 2017, both of which are hereby incorporated by reference in their entirety.

BACKGROUND

Laundry treating appliances, such as a washing machine, may implement cycles of operation in which a drum defining a treating chamber for receiving a laundry load is rotated at high speeds, such as a spin or water extraction phase. For example, to extract the water from the laundry load, the drum is typically spun at high speeds. If a sufficiently large enough load imbalance is present, the laundry treating appliance may experience undesirable vibrations and movements when the drum is rotated at high speeds during the spin phase.

BRIEF DESCRIPTION

In one aspect of the present disclosure, a laundry treating appliance includes a cover operably coupled to a portion of a wall forming at least a portion of the treating chamber, the cover having an open annular groove forming a U-shaped cross-section, an enclosed annular housing operably coupled to the cover, the enclosed annular housing defining a hollow annular raceway and a mass disposed in the hollow annular raceway and movable therein.

DETAILED DESCRIPTION

Figure 1:
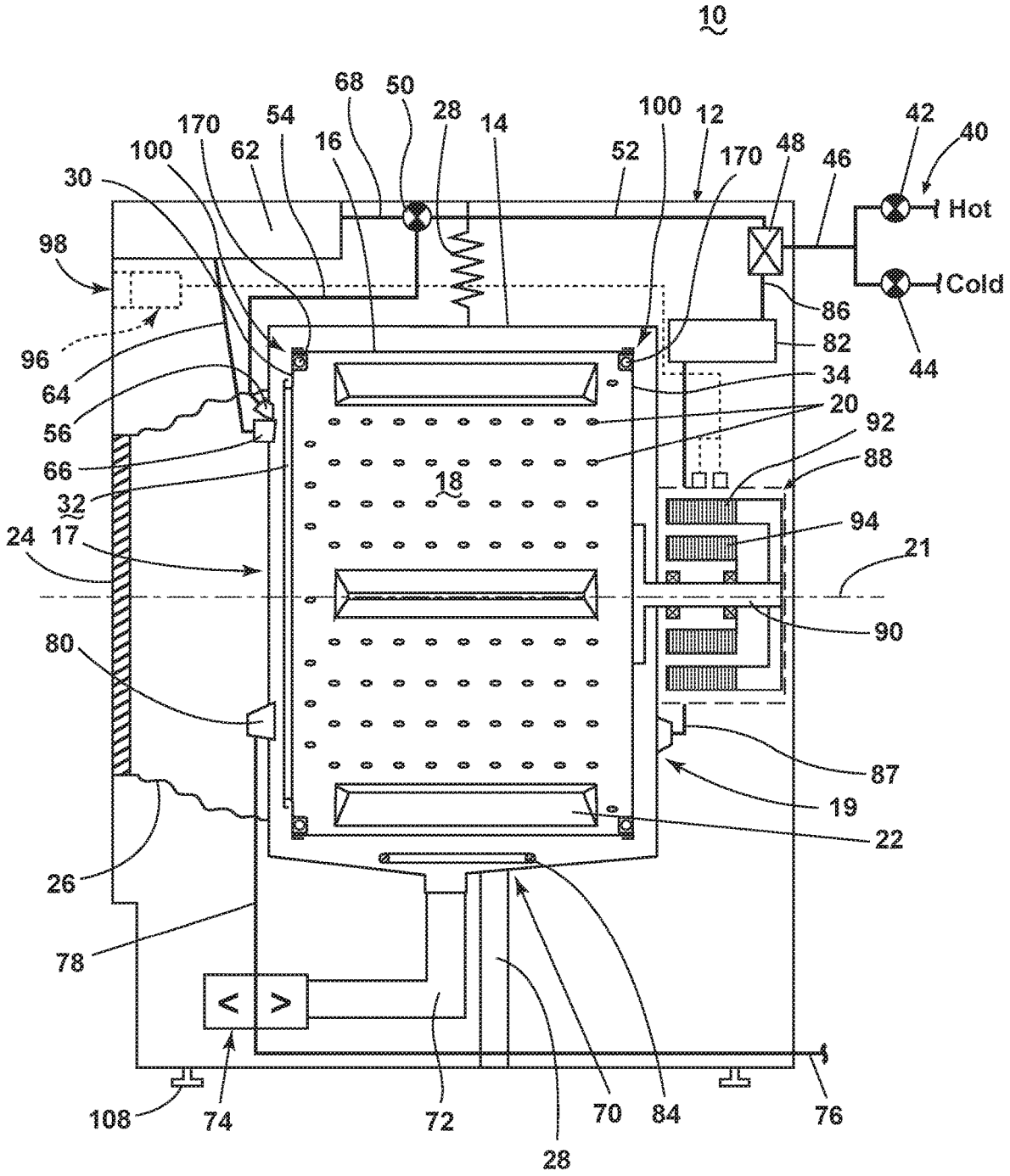
FIG. 1 is a schematic view of a laundry treating appliance in the form of a washing machine according to an embodiment of the invention.

FIG. 1 is a schematic view of a laundry treating appliance according to a first embodiment of the invention. The laundry treating appliance may be any appliance which performs a cycle of operation to clean or otherwise treat items placed therein, non-limiting examples of which include a horizontal or vertical axis clothes washer; a combination washing machine and dryer; a tumbling or stationary refreshing/revitalizing machine; an extractor; a non-aqueous washing apparatus; and a revitalizing machine.

The laundry treating appliance of FIG. 1 is illustrated as a washing machine 10, which may include a structural support system comprising a cabinet 12 which defines a housing within which a laundry holding system resides. The cabinet 12 may be a housing having a chassis and/or a frame, defining an interior that encloses components typically found in a conventional washing machine, such as motors, pumps, fluid lines, controls, sensors, transducers, and the like. Such components will not be described further herein except as necessary for a complete understanding of embodiments of the invention.

Figure 6:
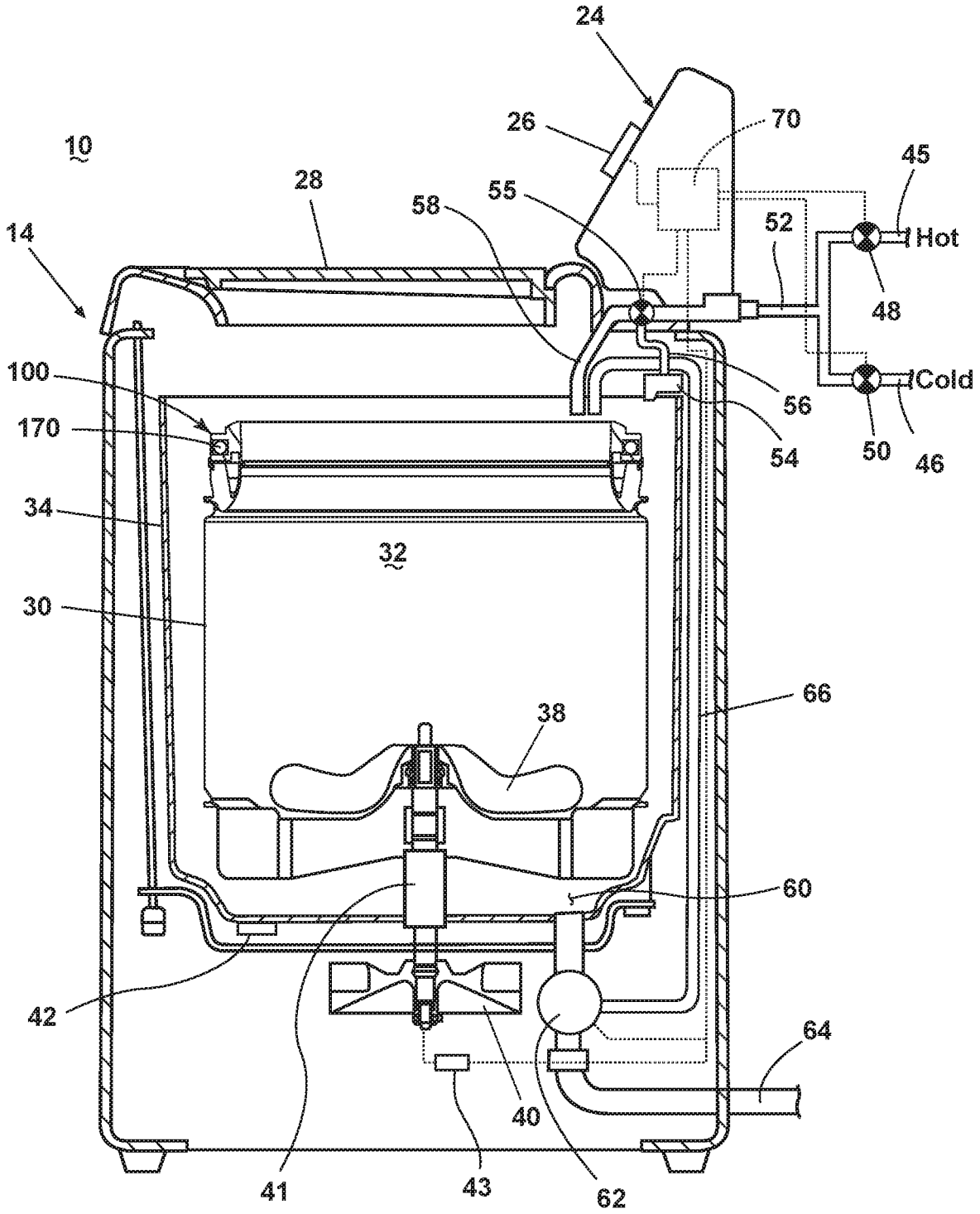
FIG. 6 is a schematic view of a laundry treating appliance in the form of a washing machine according to another embodiment of the invention.

The laundry holding system comprises a tub 14 supported within the cabinet 12 by a suitable suspension system and a rotatable drum 16 provided within the tub 14, the rotatable drum 16 defining at least a portion of a laundry treating chamber 18 having a longitudinal axis 21. The longitudinal axis 21 of the rotatable drum 16 is preferably coincident with a horizontal or non-vertical axis of rotation of the drum 16, though it is within the scope of the invention to accommodate a rotatable drum on a vertical axis of rotation. See, for example, an embodiment of a vertical axis washing machine according to another embodiment of the invention in FIG. 6. The rotatable drum 16 may include a plurality of perforations 20 such that liquid may flow between the tub 14 and the rotatable drum 16 through the perforations 20. A plurality of baffles 22 may be disposed on an inner surface of the rotatable drum 16 to lift the laundry load received in the treating chamber 18 while the rotatable drum 16 rotates. It is also within the scope of the invention for the laundry holding system to comprise only a tub with the tub defining the laundry treating chamber.

The rotatable drum 16 has a front side 17 and a rear side 19, respectively, at each end. The front side 17 includes a front cover 30 with an opening 32 therein to accommodate receiving a laundry load. The rear side 19 also has a rear cover 34. The covers 30, 34 thus form part of the drum 16.

The laundry holding system may further include a door 24 which may be movably mounted to the cabinet 12 to selectively close both the tub 14 and the drum 16. A bellows 26 may couple an open face of the tub 14 with the cabinet 12, with the door 24 sealing against the bellows 26 when the door 24 closes the tub 14.

The washing machine 10 may further include a suspension system 28 for dynamically suspending the laundry holding system within the structural support system.

The washing machine 10 may further include a liquid supply system for supplying water to the washing machine 10 for use in treating laundry during a cycle of operation. The liquid supply system may include a source of water, such as a household water supply 40, which may include separate valves 42 and 44 for controlling the flow of hot and cold water, respectively. Water may be supplied through an inlet conduit 46 directly to the tub 14 by controlling first and second diverter mechanisms 48 and 50, respectively. The diverter mechanisms 48, 50 may be a diverter valve having two outlets such that the diverter mechanisms 48, 50 may selectively direct a flow of liquid to one or both of two flow paths. Water from the household water supply 40 may flow through the inlet conduit 46 to the first diverter mechanism 48 which may direct the flow of liquid to a supply conduit 52. The second diverter mechanism 50 on the supply conduit 52 may direct the flow of liquid to a tub outlet conduit 54 which may be provided with a spray nozzle 56 configured to spray the flow of liquid into the tub 14. In this manner, water from the household water supply 40 may be supplied directly to the tub 14.

The washing machine 10 may also be provided with a dispensing system for dispensing treating chemistry to the treating chamber 18 for use in treating the laundry according to a cycle of operation. The dispensing system may include a dispenser 62 which may be a single use dispenser, a bulk dispenser or a combination of a single use and a bulk dispenser. Non-limiting examples of suitable dispensers are disclosed in U.S. Pat. No. 8,196,441 to Hendrickson et al., filed Jul. 1, 2008, entitled "Household Cleaning Appliance with a Dispensing System Operable Between a Single Use Dispensing System and a Bulk Dispensing System," U.S. Pat. No. 8,388,695 to Hendrickson et al., filed Jul. 1, 2008, entitled "Apparatus and Method for Controlling Laundering Cycle by Sensing Wash Aid Concentration," U.S. Pat. No. 8,397,328 to Hendrickson et al., filed Jul. 1, 2008, entitled "Apparatus and Method for Controlling Concentration of Wash Aid in Wash Liquid," U.S. Pub. No. 2010/0000581 to Doyle et al., filed Jul. 1, 2008, now U.S. Pat. No. 8,813,526, issued Aug. 26, 2014, entitled "Water Flow Paths in a Household Cleaning Appliance with Single Use and Bulk Dispensing," U.S. Pub. No. 2010/0000264 to Luckman et al., filed Jul. 1, 2008, entitled "Method for Converting a Household Cleaning Appliance with a Non-Bulk Dispensing System to a Household Cleaning Appliance with a Bulk Dispensing System," U.S. Pat. No. 8,397,544 to Hendrickson, filed Jun. 23, 2009, entitled "Household Cleaning Appliance with a Single Water Flow Path for Both Non-Bulk and Bulk Dispensing," and U.S. Pat. No. 8,438,881 to Ihne et al., filed Apr. 25, 2011, entitled "Method and Apparatus for Dispensing Treating Chemistry in a Laundry Treating Appliance," which are herein incorporated by reference in full.

Regardless of the type of dispenser used, the dispenser 62 may be configured to dispense a treating chemistry directly to the tub 14 or mixed with water from the liquid supply system through a dispensing outlet conduit 64. The dispensing outlet conduit 64 may include a dispensing nozzle 66 configured to dispense the treating chemistry into the tub 14 in a desired pattern and under a desired amount of pressure. For example, the dispensing nozzle 66 may be configured to dispense a flow or stream of treating chemistry into the tub 14 by gravity, i.e. a non-pressurized stream. Water may be supplied to the dispenser 62 from the supply conduit 52 by directing the diverter mechanism 50 to direct the flow of water to a dispensing supply conduit 68.

Non-limiting examples of treating chemistries that may be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 may also include a recirculation and drain system for recirculating liquid within the laundry holding system and draining liquid from the washing machine 10. Liquid supplied to the tub 14 through the tub outlet conduit 54 and/or the dispensing supply conduit 68 typically enters a space between the tub 14 and the drum 16 and may flow by gravity to a sump 70 formed in part by a lower portion of the tub 14. The sump 70 may also be formed by a sump conduit 72 that may fluidly couple the lower portion of the tub 14 to a pump 74. The pump 74 may direct liquid to a drain conduit 76, which may drain the liquid from the washing machine 10, or to a recirculation conduit 78, which may terminate at a recirculation inlet 80. The recirculation inlet 80 may direct the liquid from the recirculation conduit 78 into the drum 16. The recirculation inlet 80 may introduce the liquid into the drum 16 in any suitable manner, such as by spraying, dripping, or providing a steady flow of liquid. In this manner, liquid provided to the tub 14, with or without treating chemistry may be recirculated into the treating chamber 18 for treating the laundry within.

The liquid supply and/or recirculation and drain system may be provided with a heating system which may include one or more devices for heating laundry and/or liquid supplied to the tub 14, such as a steam generator 82 and/or a sump heater 84. Liquid from the household water supply 40 may be provided to the steam generator 82 through the inlet conduit 46 by controlling the first diverter mechanism 48 to direct the flow of liquid to a steam supply conduit 86. Steam generated by the steam generator 82 may be supplied to the tub 14 through a steam outlet conduit 87. The steam generator 82 may be any suitable type of steam generator such as a flow through steam generator or a tank-type steam generator. Alternatively, the sump heater 84 may be used to generate steam in place of or in addition to the steam generator 82. In addition or alternatively to generating steam, the steam generator 82 and/or sump heater 84 may be used to heat the laundry and/or liquid within the tub 14 as part of a cycle of operation.

Additionally, the liquid supply and recirculation and drain system may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system may include a motor 88, which may be directly coupled with the rotatable drum 16 through a drive shaft 90 at or about the rear cover 34 to rotate the drum 16 about a rotational axis during a cycle of operation. The motor 88 may be a brushless permanent magnet (BPM) motor having a stator 92 and a rotor 94. Alternately, the motor 88 may be coupled to the drum 16 through a belt and a drive shaft to rotate the rotatable drum 16, as is known in the art. Other motors, such as an induction motor or a permanent split capacitor (PSC) motor, may also be used. The motor 88 may rotate the drum 16 at various speeds in either rotational direction.

The washing machine 10 also includes a control system for controlling the operation of the washing machine 10 to implement one or more cycles of operation. The control system may include a controller 96 located within the cabinet 12 and a user interface 98 that is operably coupled with the controller 96. The user interface 98 may include one or more knobs, dials, switches, displays, touch screens and the like for communicating with the user, such as to receive input and provide output. The user may enter different types of information including, without limitation, cycle selection and cycle parameters, such as cycle options.

The controller 96 may include the machine controller and any additional controllers provided for controlling any of the components of the washing machine 10. For example, the controller 96 may include the machine controller and a motor controller. Many known types of controllers may be used for the controller 96. The specific type of controller is not germane to embodiments of the invention. It is contemplated that the controller is a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
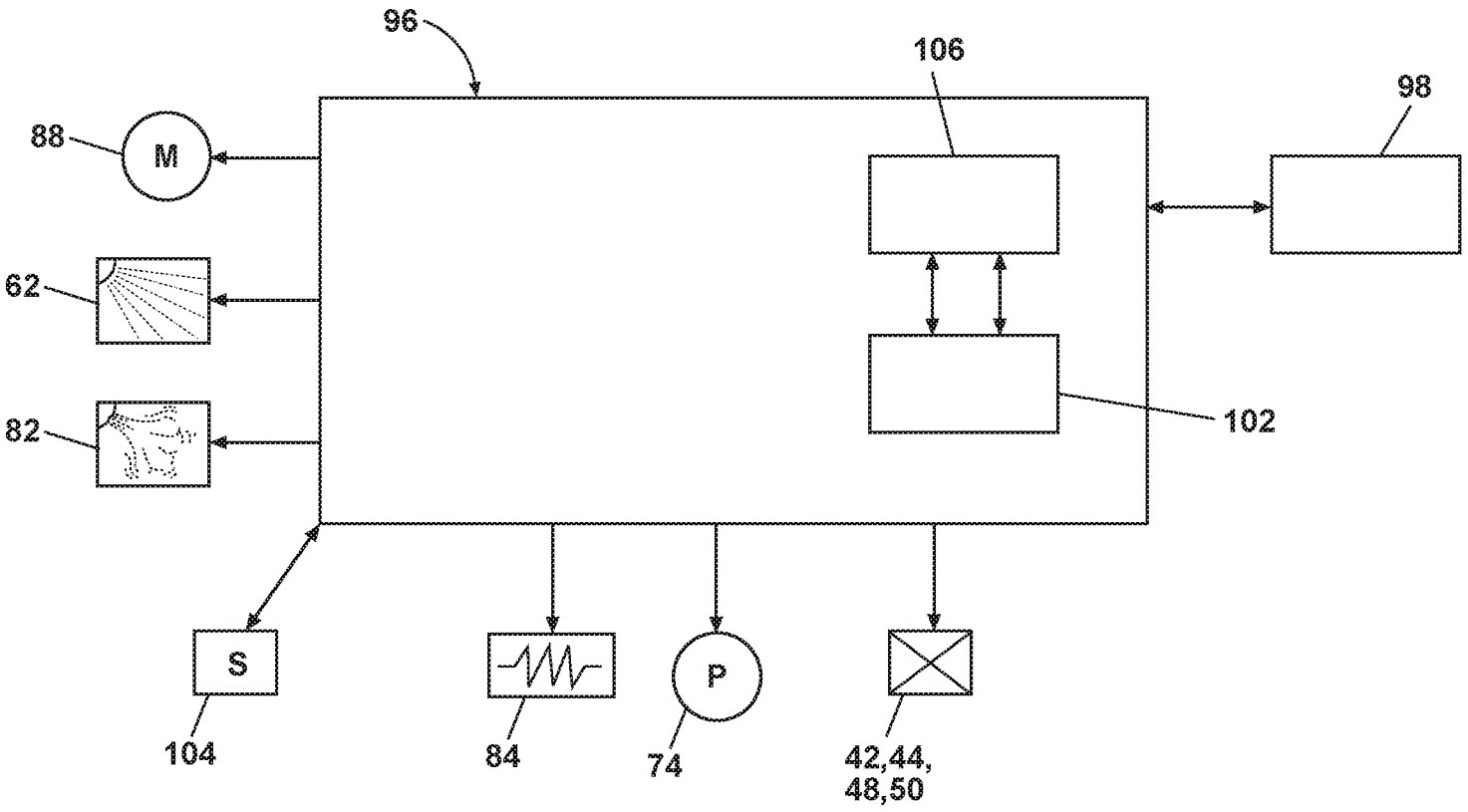
FIG. 2 is a schematic of a control system of the laundry treating appliance of FIG. 1 according to an embodiment of the invention.

As illustrated in FIG. 2, the controller 96 may be provided with a memory 106 and a central processing unit (CPU) 102. The memory 106 may be used for storing the control software that is executed by the CPU 102 in completing a cycle of operation using the washing machine 10 and any additional software. Examples, without limitation, of cycles of operation include: wash, heavy duty wash, delicate wash, quick wash, pre-wash, refresh, rinse only, and timed wash. The memory 106 may also be used to store information, such as a database or table, and to store data received from one or more components of the washing machine 10 that may be communicably coupled with the controller 96. The database or table may be used to store the various operating parameters for the one or more cycles of operation, including factory default values for the operating parameters and any adjustments to them by the control system or by user input.

The controller 96 may be operably coupled with one or more components of the washing machine 10 for communicating with and controlling the operation of the component to complete a cycle of operation. For example, the controller 96 may be operably coupled with the motor 88, the pump 74, the dispenser 62, the steam generator 82 and the sump heater 84 to control the operation of these and other components to implement one or more of the cycles of operation.

The controller 96 may also be coupled with one or more sensors 104 provided in one or more of the systems of the washing machine 10 to receive input from the sensors, which are known in the art and not shown for simplicity. Non-limiting examples of sensors 104 that may be communicably coupled with the controller 96 include: a treating chamber temperature sensor, a moisture sensor, a weight sensor, a chemical sensor, a position sensor and a motor torque sensor, which may be used to determine a variety of system and laundry characteristics, such as laundry load inertia or mass.

The laundry treating appliance 10 may also include a dynamic balancer 100 at the front 17 and/or rear 19 side of the rotatable drum 16 which includes a moveable mass 170 to offset an imbalance that may occur in the treating chamber 18 during rotation of the rotatable drum 16 during a cycle of operation. In FIG. 1 a dynamic balancer 100 is shown at both the front 17 and rear 19 sides of the rotatable drum 16, secured to the front and rear covers 30, 34, respectively.

During a cycle of operation in which the drum 16 is rotated, the moveable mass 170 may apply pressure to parts of the balancer 100 as a result of the centrifugal force applied to the moveable mass 170, especially when the moveable mass 170 includes spherical weights, such as steel balls. Metal is generally stiffer than plastic and thus may be less likely to be deformed or damaged as a result of the centrifugal force applied to the moveable mass 170. However, contact between the moveable mass 170 and metal components of the balancer 100 during rotation of the drum 16 may generate undesirable sound. The balancer 100 may be provided with a sound damping component or combination of sound damping components to reduce undesirable sound generated by the balancer 100. As used herein, sound damping refers to reducing undesirable sound by absorption and/or redirection of sound waves. The balancers described herein combine the strength properties of metal with the sound damping properties of plastic to provide a balancer which is less likely to be deformed or damaged in use while attenuating undesirable sounds that may be generated by movement of the mass within the balancer.

Figure 3:
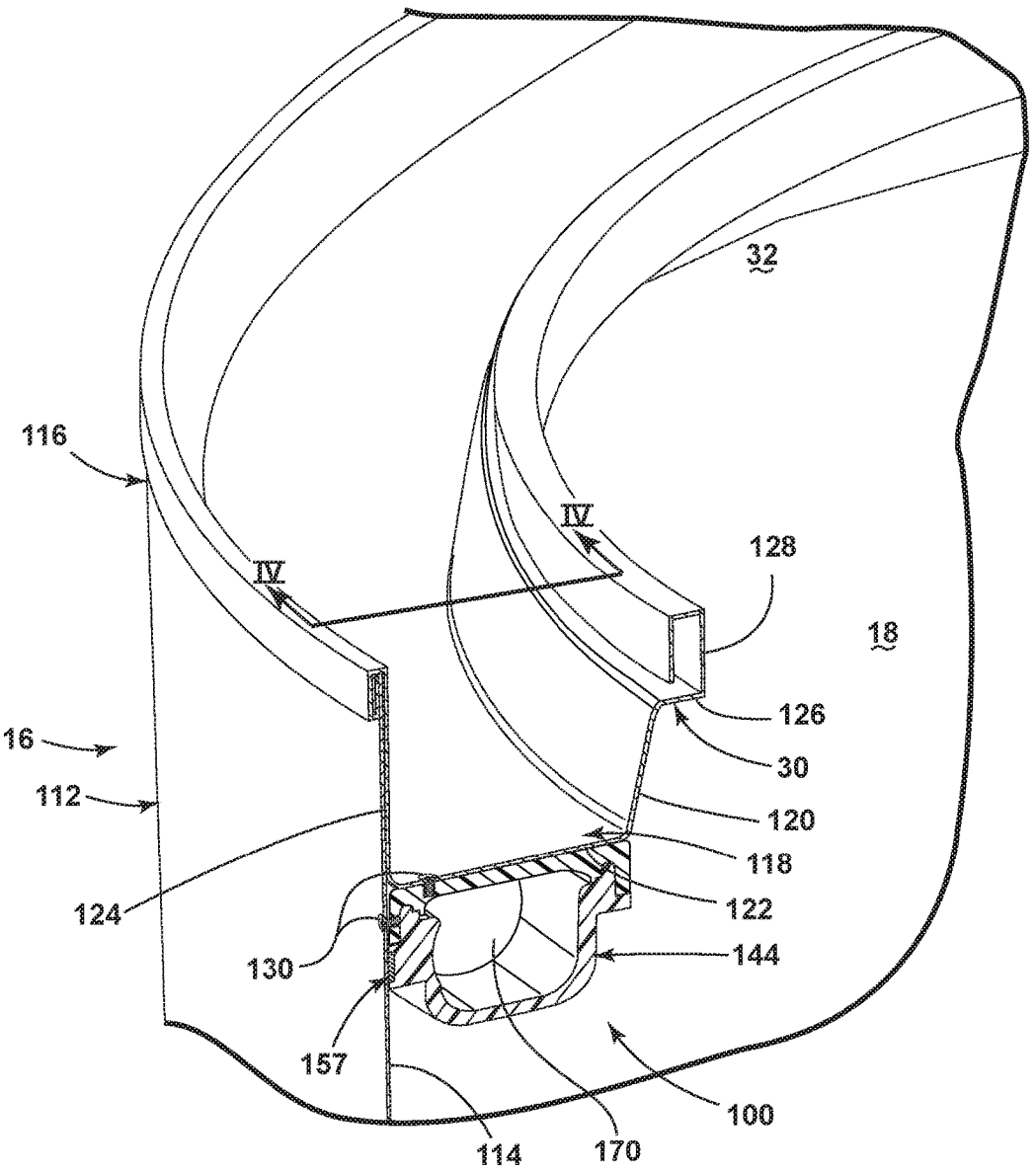
FIG. 3 is an isometric view, partly in cross section, of a dynamic balancer in accordance with an embodiment of the invention.
Figure 4:
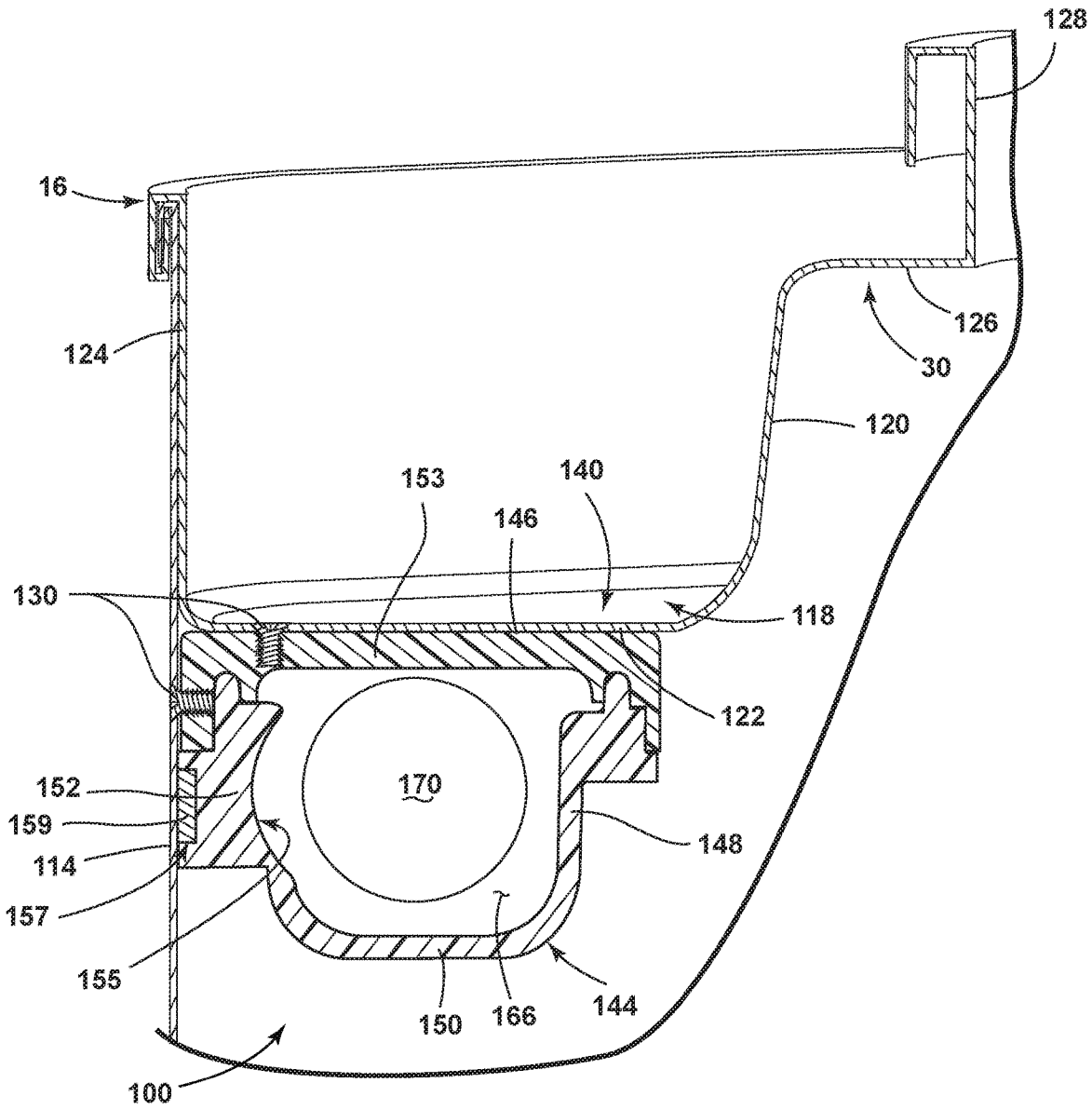
FIG. 4 is a cross section of the dynamic balancer of FIG. 3 taken along lines IV-IV.

FIGS. 3-4 illustrate views of an embodiment of the dynamic balancer 100 in the context of a front cover 30 and its opening 32. Looking again also at FIG. 1, the dynamic balancer 100 is disposed coaxially with the longitudinal axis 21 of the treating chamber 18. The rotatable drum 16 encloses the treating chamber 18 in a cylindrical body 112 defined in part by a cylindrical wall 114, extending along the longitudinal axis 21 and the front cover 30. The front cover 30 is coupled to the cylindrical wall 114 at a suitable junction 116, which may include any of or any combination of crimping, welding, riveting, fastening, screwing, or the like. The front cover 30 of the drum 16 has an annular groove 118 defined by a first annular groove wall 124 adjacent to the cylindrical wall 114, a second annular groove wall 120 spaced from the first wall 124 and generally parallel to the first wall 124, and third annular groove wall 122 extending between the first and second walls 124, 120. A fourth annular groove wall 126 includes at least a portion thereof extending from the second wall 120 to an edge 128 that defines the opening 32. At least a portion of the fourth annular groove wall 126 extends generally normal to the longitudinal axis 21. In other words, it will be understood that the fourth annular groove wall 126 need not be planar and portions thereof may vary in orientation relative to the longitudinal axis 21. The front cover 30 is preferably a metal cover, and may be made from, for example, a metal such as stainless steel, as is preferably the cylindrical wall 114.

The balancer 100 includes an enclosed non-metal annular housing 140 having a first housing piece 144 and a second, cover housing piece 146. The annular non-metal housing 140 may be made from any suitable non-metal material, such as a polymeric material, which may be formed by a suitable molding process. The first housing piece 144 has a generally U-shaped cross-section defined by a first housing wall 148, a second housing wall 150, or a bottom wall, and a third housing wall 152. As used herein, reference to a radial wall, or radial circumferential wall, refers to a part or portion of a part which defines a radial circumferential limit of motion of the mass 170 during rotation of the drum 16 about the longitudinal axis 21. The outer radial circumferential wall may be formed by just the third housing wall 152 or a combination of the third housing wall 152 and adjacent portions of the housing 140, and the inner radial circumferential wall may be formed by just the first housing wall 148 or a combination of the first housing wall 148 and adjacent portions of the housing 140.

The second housing piece 146 may be joined with the first and third housing walls 148, 152 of the first housing piece 144 by any suitable mechanical and/or non-mechanical fasteners, non-limiting examples of which include a tongue and groove connection (shown), a weld, a snap-fit connection, an adhesive, screws, rivets, crimping, bolting, and bosses. In this sense, the second housing piece 146 may be joined with the first housing piece 144 to provide an enclosed hollow annular space defined by the first, second (bottom), and third walls of the first housing piece 144, with the second housing piece 146 defining a fourth (top) wall 153 of the enclosed annular space.

The balancer 100 may further comprise a groove 157 in the third housing wall 152 configured to receive a stiffening ring 159 configured to prevent distortion of the balancer 100 during rotation of the drum 16. The stiffening ring may be formed from a metallic or non-metallic material configured to oppose the centrifugal forces of the mass 170 as it rotates within the balancer 100. As shown, the groove 157 and stiffening ring 159 are positioned at the interface between the third housing wall 152 and the cylindrical wall 114; however alternative configurations may be included wherein, for example, the groove 157 and ring 159 are integrated into the first and/or second housing pieces 144, 146. Furthermore, while the stiffening ring 159 is illustrated having a substantially rectangular cross-section, alternative geometric configurations may be included wherein the geometric configuration affects the stiffening characteristics of the ring 159.

The walls 148, 150, 152, 153 defining the annular raceway 166 may further define a curvature 155 configured to direct the mass 170 toward the center of the third housing wall 152 during rotation of the drum 16. As shown, at least a portion of the third and fourth housing walls 152, 153 include the curvature 155; however, additional, fewer, and/or alternative walls 148, 150, 152, 153 may include the curvature 155 described.

The first, second, third, and fourth walls 148, 150, 152, 153 enclosing the annular space define a hollow annular raceway 166 within which the mass 170 may move. The mass 170 may include a fluid, such as water, salt water, oil or other viscous fluid, for example, and optionally one or more moveable weights, such as spherical balls. The mass 170 may partially fill the raceway 166 and may distribute or collect unevenly to offset an unbalanced condition in the rotatable drum 16.

The balancer 100 may be positioned and/or located adjacent to the cylindrical wall 114 and the third annular groove wall 122 of the front cover 30, opposite the annular groove 118. Stated another way, the top wall 153 of the balancer 100 abuts the third annular groove wall 122 opposite the annular groove 118, and the third housing wall 152 of the balancer 100 abuts the cylindrical wall 114. The balancer 100 may be fixed in this position by mechanical fasteners, such as screws 130, or any other alternative or additional mechanical or non-mechanical fasteners, non-limiting examples of which include spring-clips, adhesives, welds, snap-fit connections, and tongue and groove connections. While the illustrated embodiment is shown fixed in the location by a screw 130 coupling the balancer 100 with the third annular groove wall 122 and a screw 130 coupling the balancer 100 with the cylindrical wall 114, embodiments of the invention may include additional or fewer fasteners, or alternatively placed fasteners. For example, embodiments of the invention may include fasteners extending from one of the third annular groove wall 122 or the cylindrical wall 114, into the respective fourth housing wall 153 or third housing wall 152 of the balancer 100, to secure the balancer 100 to the rotatable drum 16.

The laundry treating appliance 10 may be assembled by, for example, forming the front cover 30 having the annular groove 118 at a peripheral edge thereof, forming a sidewall wrapper of the drum 16 having a cylindrical wall 114, with, for example, a sidewall flange extending from the cylindrical wall 114, securing the balancer 100 to the third wall 122, opposite the annular groove 118. The sidewall wrapper may then be slid over the outer radial wall of the drum 16, and with the first wall 124 of the cover 30, until the sidewall flange meets the cover flange, and finally, for example, crimping the sidewall flange to the cover 30 flange. Alternatively the balancer 100 may be secured to the cylindrical wall 114, spaced from the sidewall flange, such that the sliding of the sidewall wrapper over the first wall until the sidewall flange meets the cover flange and the balancer 110 meets the cover 30 occurs, whereupon the sidewall flange may be crimped to the cover flange.

In yet another assembling configuration, the annular housing 140 may be assembled either before or after the annular housing 140 is coupled with the drum cover 30 and/or the cylindrical wall 114. In one example, the second housing piece 146 may be secured to the drum cover 30 prior to the joining of the first and second housing pieces 144, 146. In this instance, the balancer 100 may be fully assembled, and the drum cover 30 with balancer 100 may then be secured with the rotatable drum 16, and/or the balancer 100 may then be secured with the cylindrical wall 114. Alternatively, the first housing piece 144 may be secured to the cylindrical wall 114 prior to the joining of the first and second housing pieces 144, 146. In this instance, the balancer 100 may be fully assembled, and the rotatable drum 16 with balancer 100 may then be secured with the drum cover 30, and/or the balancer 100 may then be secured with the drum cover 30. In yet another example, the first and second housing pieces 144, 146 may be joined prior to the securing to either of the drum cover 30 and/or the cylindrical wall 114. In any assembling configuration, the stiffing ring 159 may be added to the third housing wall 152 prior to, for example, the sliding step, or prior to the securing of the balancer 100 to either the drum 16 or cover 30.

In any assembly method, the mass 170 may be provided within the annular raceway 166 prior to joining of the first and second housing pieces 144, 146. A fluid, such as oil, may be added to the annular raceway 166 through a port in at least one of the first and second housing pieces 144, 146 after joining the housing pieces 144, 146, or may be added to the raceway 166 prior to the joining of the housing pieces 144, 146. In yet another example, the moveable mass 170 may include a combination of balls and a fluid. The balls may be provided in the annular raceway 166 prior to the joining of the housing pieces 144, 146 and the fluid may be added through appropriate ports in at least one of the first and second housing pieces 144, 146. Alternatively, the moveable mass 170, either balls, fluid, or a combination of balls and fluid, may be added to the annular raceway 166 through appropriate sized port(s) provided in at least one of the first and second housing pieces 144, 146.

Figure 5:
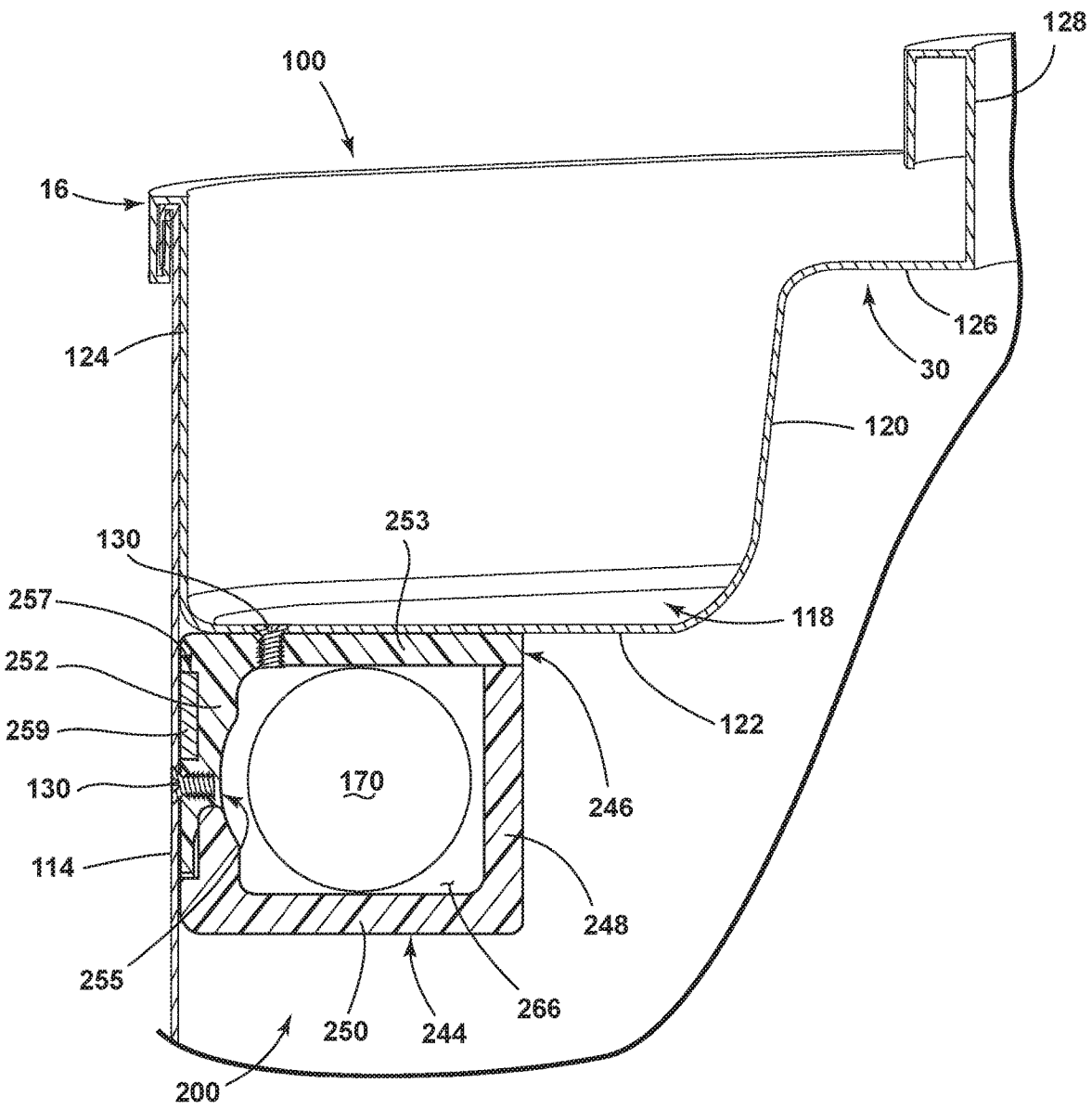
FIG. 5 is a cross section of a dynamic balancer in accordance with another embodiment of the invention.

FIG. 5 illustrates another embodiment of the balancer 200 which is similar to the balancer 100 except that the non-metal annular housing 140 is formed from two pieces having an L-shaped cross-section rather than the U-shaped cross-section of the balancer 100. Therefore, elements of the balancer 200 similar to those of the balancer 100 are labeled with the prefix 200.

The first housing piece 244 includes an L-shaped cross-section piece formed by the first housing leg 248 and the second housing leg 250 that is joined with the second housing piece 246. The second housing piece 246 includes an L-shaped cross-section piece formed by the third housing leg 252 and the fourth housing leg 253 with the fourth housing leg 253 joined with the first housing leg 248 and the third housing wall leg 252 joined with the second housing leg 250 to form an enclosed annular raceway 266. The first and second housing pieces 244 and 246 may be joined by any suitable mechanical and/or non-mechanical fasteners, non-limiting examples of which include a tongue and groove connection, a weld, a snap-fit connection, an adhesive, screws, rivets, and bosses.

The balancer 200 may be provided on the drum 16 such that the first housing leg 248 forms the inner radial wall, the third housing leg 252 forms the outer radial wall, and the second and fourth housing legs 250, 253 form the bottom and top walls, with respect to the longitudinal axis 21 of the drum 16. In this sense, the second housing piece 246 may be joined with the first housing piece 244 to provide an enclosed hollow annular space defined by the first and second (bottom) legs of the first housing piece 244, with the second housing piece 246 defining the third and fourth (top) legs 252, 253 of the enclosed annular space.

Similar to the balancer 100 described above, the mass 170 may be provided within the raceway 266 before or after first and second housing pieces are joined. Additionally, while not shown, any of the housing legs 246, 248, 250, 252 may include an optional curvature 255, as described above.

It will be understood that more than one dynamic balancer 100, 200 may be disposed in a laundry treating device. For example, in a horizontal axis washing machine, there may be a dynamic balancer 100, 200 at both the front and rear sides 17, 19 of the rotatable drum 16. It will be further understood that the dynamic balancer 100, 200 may be coupled with the drum 16 anywhere on the covers 30, 34 or on the cylindrical wall 114. As well, the covers 30, 34 may or may not have an annular groove 118.

The dynamic balancers 100, 200 herein describe a non-metal housing to dampen sound generated by movement of the moveable mass 170 within the metal race. As discussed above, during a cycle of operation in which the drum 16 is rotated, the components of the balancers 100, 200 may experience centrifugal forces acting upon them by the moveable mass 170 therein, especially when the drum 16 is rotated at high speeds. During the rotation of the drum 16, the optional curvatures 155 may direct the mass 170 toward a center of the outer radial wall. When the moveable mass 170 is in the form of a metal ball, contact between the balls and plastic forming the annular raceway within which the mass 170 moves may deform or damage the plastic and may inhibit free rolling motion of the balls over time. The inclusion of the optional stiffening ring 159 may decrease the likelihood of deformation or damage of the raceway over time, while reducing the undesirable noise of the mass 170 movement within the raceway 166, 266.

The dynamic balancers 100, 200 described herein may provide a stiffening ring 159 along at least a portion of the outer radial circumferential wall of the non-metal housing to increase the stiffness of the portion of the raceway which experiences the majority of the centrifugal forces present during rotation of the drum 16. During rotation of the drum 16, the mass 170 experiences centrifugal forces which propels the mass 170 radially outward from the axis of rotation of the drum and therefore the portion of the balancer defining the radial circumferential limit of motion for the mass 170 experiences pressure from the centrifugal force of the mass 170. The portion of the balancer defining the radial circumferential limit of motion for the mass 170 may include a single wall or leg of the annular housing or a combination of multiple walls or legs.

To the extent not already described, the different features and structures of the various embodiments may be used in combination with each other as desired. That one feature may not be illustrated in all of the embodiments is not meant to be construed that it cannot be, but is done for brevity of description. Thus, the various features of the different embodiments may be mixed and matched as desired to form new embodiments, whether or not the new embodiments are expressly disclosed.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of assembling a laundry treating appliance, the method comprising:

operably coupling to a rotatable drum, configured to receive a laundry load and including a cylindrical wall, a metal cover having an annular groove formed by a first wall, a second wall spaced from the first wall, and a third wall extending between a proximal edge of the first wall and a proximal edge of the second wall, where the annular groove is open between a distal edge of the first wall and a distal edge of the second wall;

operably coupling an enclosed non-metal annular housing having an outer radial wall, an inner radial wall, a top wall, and a bottom wall defining a hollow annular raceway where the enclosed non-metal annular housing is operably coupled to the annular groove; and disposing a mass in the hollow annular raceway, the disposable mass movable therein.

2. The method of claim 1 wherein operably coupling the rotatable drum to the metal cover includes operably coupling the first wall of the metal cover to the cylindrical wall of the rotatable drum.

3. The method of claim 1 wherein operably coupling the rotatable drum to the metal cover comprises crimping a flange extending from the cylindrical wall to a portion of the metal cover.

4. The method of claim 3 wherein the metal cover further comprises a cover flange and the cover flange and the flange extending from the cylindrical wall are crimped together.

5. The method of claim 1, further comprising adding a stiffening ring to the enclosed non-metal annular housing.

6. The method of claim 1 wherein operably coupling the enclosed non-metal annular housing to the annular groove includes securing by fastening by at least one fastener.

7. The method of claim 6 wherein the at least one fastener is one of a screw, a rivet, a crimp, a snap fit, or a bolt.

8. The method of claim 6 wherein the at least one fastener extends from the metal cover into the enclosed non-metal annular housing to secure the metal cover to the non-metal annular housing.

9. The method of claim 1 wherein the enclosed non-metal annular housing comprises at least two pieces operably coupled together to define the hollow annular raceway.

10. A method of assembling a laundry treating appliance, the method comprising:

operably coupling a cover to a wall forming at least a portion of a treating chamber configured to receive a laundry load, the cover having an open annular groove forming a U-shaped cross-section;

operably coupling an enclosed annular housing to the cover, the enclosed annular housing defining a hollow annular raceway; and disposing a mass in the hollow annular raceway, the mass movable therein.

11. The method of claim 10 wherein operably coupling the cover to a wall includes operably coupling a first flange extending from the U-shaped cross-section to the wall.

12. The method of claim 11 wherein operably coupling the cover to the wall comprises crimping the first flange extending from the U-shaped cross-section to the wall.

13. The method of claim 12 wherein the wall further comprises a second flange and the operably coupling comprises crimping the first flange and the second flange.

14. The method of claim 10 wherein operably coupling the enclosed annular housing to the cover includes securing by fastening by at least one fastener.

15. The method of claim 14 wherein the at least one fastener is one of a screw, a rivet, a crimp, a snap fit, or a bolt.

16. The method of claim 14 wherein the at least one fastener extends from the cover into the enclosed annular housing to secure the cover to the enclosed annular housing.

17. The method of claim 10 wherein the hollow annular raceway has a curvature configured to direct the mass toward a center of an outer radial wall.

18. The method of claim 17 wherein the curvature is in the outer radial wall.

19. The method of claim 10, further comprising locating a stiffening ring within a portion of the enclosed annular housing.

20. The method of claim 19 wherein the enclosed annular housing further comprises a groove on its exterior configured to receive the stiffening ring.

* * * * *